United States Patent [19]

Jennings

[11] 4,146,919

[45] Mar. 27, 1979

[54] ROTATING HANGING LAMP

[76] Inventor: John E. Jennings, 1812 S. Date Ave., Alhambra, Calif. 91803

[21] Appl. No.: 766,569

[22] Filed: Feb. 7, 1977

[51] Int. Cl.[2] ..... F21V 21/30

[52] U.S. Cl. ..... 362/35; 362/147; 362/271; 362/363; 362/423; 362/404; 362/806

[58] Field of Search ..... 362/35, 271, 272, 285, 362/363, 371, 423, 809, 806, 86, 147, 404, 206

[56] References Cited

U.S. PATENT DOCUMENTS

| | | | |
|---|---|---|---|
| 2,608,779 | 9/1952 | Joy | 362/809 |
| 3,194,952 | 7/1965 | Wells | 362/86 |
| 4,054,286 | 10/1977 | Dressler | 362/86 |

*Primary Examiner*—Stephen J. Lechert, Jr.

[57] ABSTRACT

A rotating hanging lamp which is constructed of a fixed member and a movable member with the exterior surface of the movable member being substantially greater than the external surface of the fixed member. The fixed member is divided into an upper section and a lower section with the movable member located therebetween. The movable member is rotatably supported upon the fixed member by means of a low frictional wheel assembly which connects with an annular inwardly extending flange mounted upon the movable member. The annular inwardly extending flange also connects with a drive wheel which is rotatably mounted upon the fixed member. The drive wheel is rotatably driven by a motor which is mounted upon the fixed member.

7 Claims, 4 Drawing Figures

ROTATING HANGING LAMP

BACKGROUND OF THE INVENTION

The field of this invention relates to decorative and ornamental lighting devices.

Heretofore, lighting devices have long been provided which are ornamental in appearance and include decorative displays. Also, another feature frequently incorporated in hanging lamps includes forming the hanging lamp into the shape of a sphere and having a portion of the sphere revolve. With the lighting means located within the sphere, the revolving of the sphere is capable of producing a unique appearance. This sphere may have jewel like windows or transparent lenses which may assume the form of faceted elements of glass or translucent plastic material through which light may pass to provide a spectacular display of colored light rays.

While revolving and illuminated displays are generally well known, the present invention contemplates improvements over known devices and that it embodies novel structural features and arrangements, resulting not only in a spectacular display and improved appearance and extreme compactness, but also simplifying manufacture and facilitating assembly.

SUMMARY OF THE INVENTION

Briefly described the present invention includes a fixed portion and a moveable portion. The fixed portion includes an upper segment of a sphere and the lower portion includes a lower segment of the sphere. The remainder of the sphere is comprised of the moveable portion. A support bracket is mounted to a rod coupled between the upper portion and the lower portion and rotatably supports the moveable portion. Drive means is attached to the support portion and imparts rotation to the moveable portion by use of a drive motor and drive wheel which rotates a flange coupled to the moveable portion. Electrically operated apparatus is mounted on the fixed portion and the control for the apparatus is on a stationary annular ring disposed on the lower portion of the fixed portion for easy access.

The primary objective of this invention is to design a hanging lamp structure which is composed of few parts and can be manufactured inexpensively.

Another feature of this invention is that the major portion of the exterior surface of the lamp of this invention revolves which therefore substantially increases the ornamental unique effect which has previously not been possible with known types of revolving hanging lamps.

Another feature of this invention is that the hanging lamp assembly can readily include other electronic apparatus, such as a radio, a stereo, stereo speakers, or any other desirable type of electronic equipment.

In appearance the present invention is in the form of a round ball or sphere which may hang from the ceiling of a room or extended from other suitable hanging devices. Suspension of the device is by a stationary rod 12 whereby certain components of the sphere are stationary while other components revolve for ornamental and decorative purposes. The lamp structure 14 is secured to the rod 12 and does not revolve thus the wiring used for connecting the lamps to a power source does not twist during revolution.

Bracket 16 couples the annular ring 18 to the rod 12 so that it also remains stationary. Therefore, the tuning or switching knobs 22 and 24 also remain stationary. Wires and other lead lines (not shown) coupling the knob devices 22 and 24 to the electronic equipment are in the stationary period at all times and may even be placed within the rod 12.

DETAILED DESCRIPTION OF THE SHOWN EMBODIMENT

Figure 1:
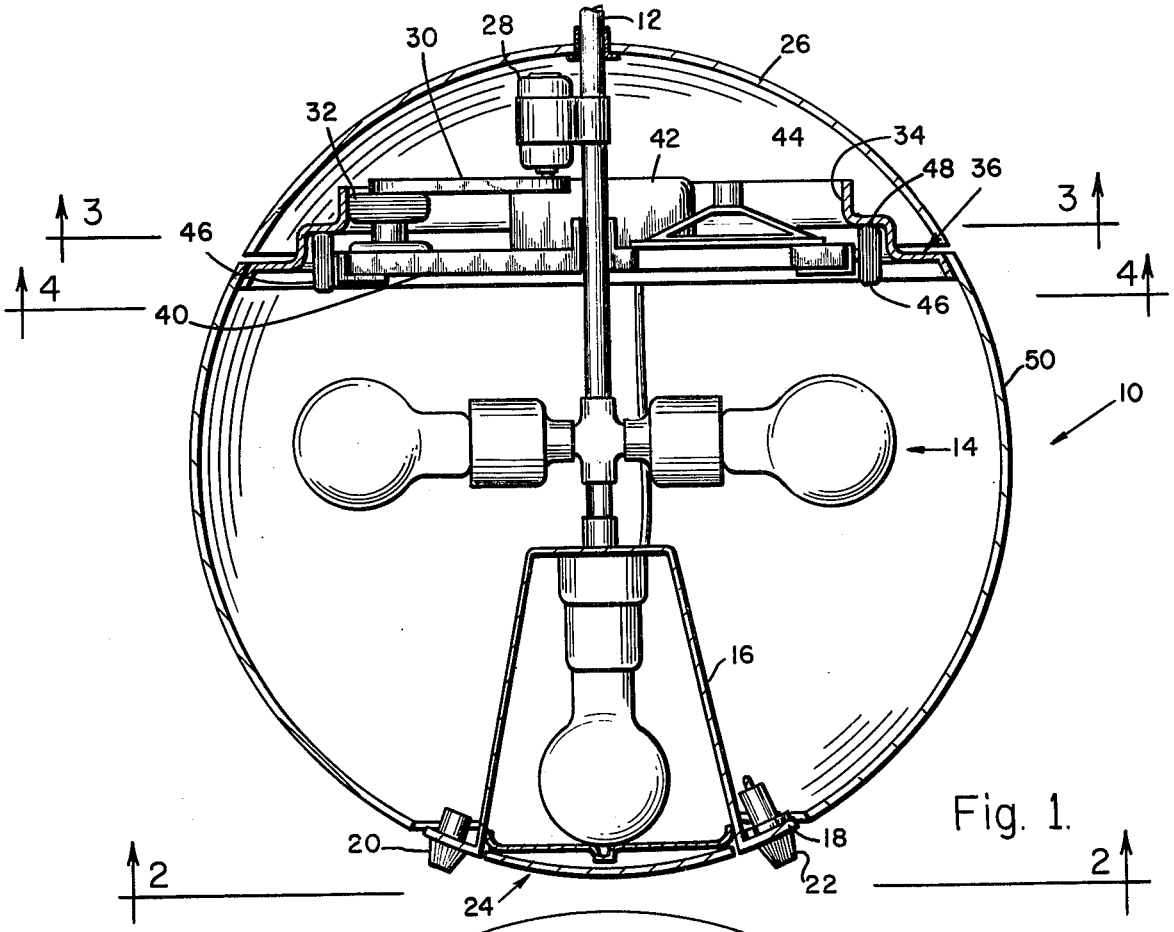
FIG. 1 is a cross-sectional view of the hanging lamp structure of this invention.
Figure 2:
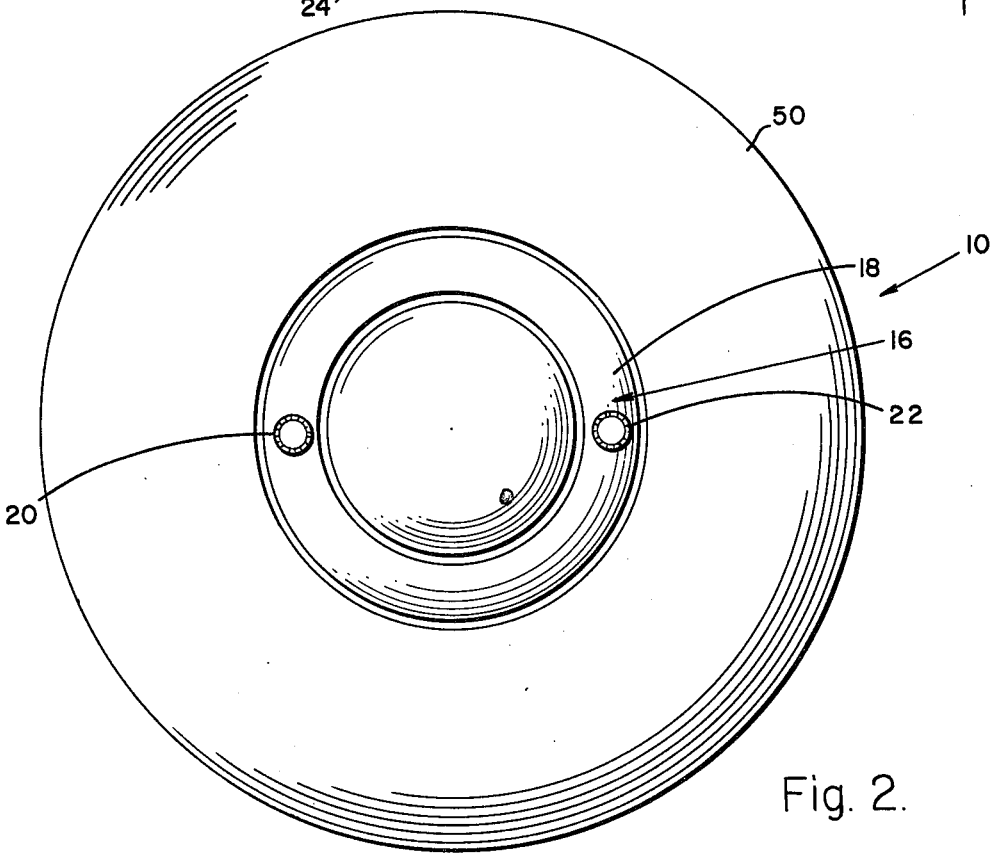
FIG. 2 is a bottom view of the hanging lamp of this invention taken along line 2—2 of FIG. 1.
Figure 3:
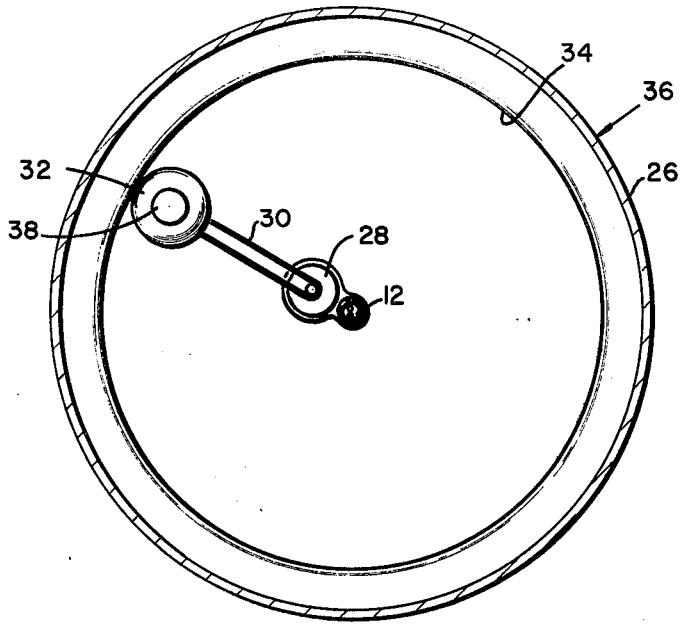
FIG. 3 is a cross-sectional view taken along line 3—3 of FIG. 1.
Figure 4:
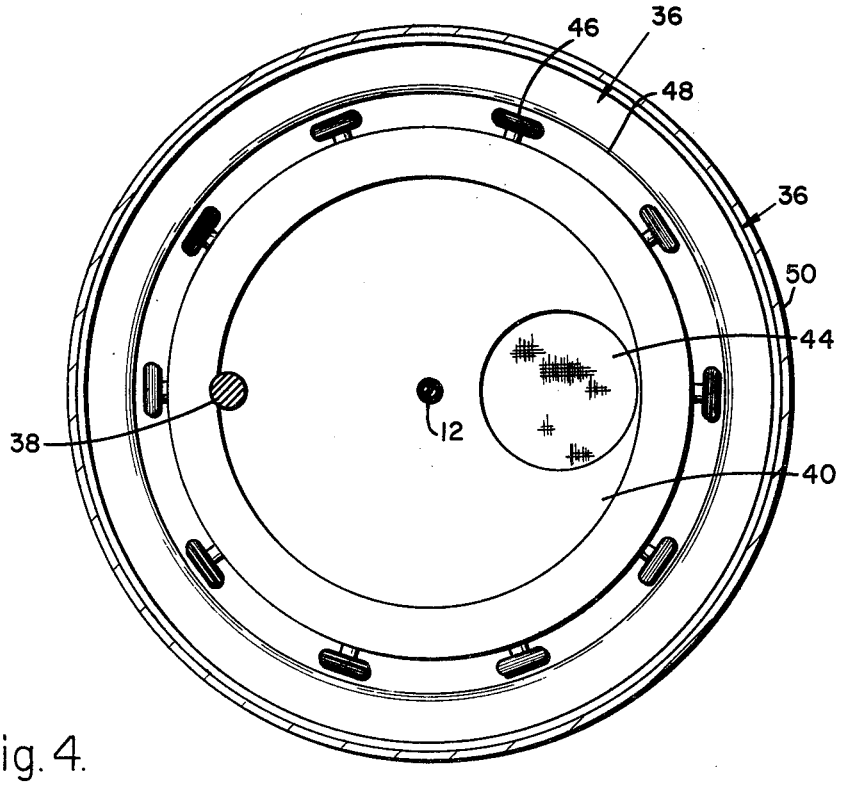
FIG. 4 is a cross-sectional view taken along line 4—4 of FIG. 1.

Referring particularly to the drawings, there is shown lamp 10 of this invention which is adapted to be suspended from a horizontal surface, such as a ceiling (not shown) by means of metal rod 12. The rod 12 is to be hollow and is to permit passage therethrough of electrical wiring. The electrical wiring is to connect to an electric lamp assembly 14 which, in this particular instance, is shown to be three separate lamps, but could comprise any number of lamps.

Attached to the lamp assembly 14 at the bottom of rod 12 is a bracket 16. The bracket 16 is fixed in respect to the rod 12 and includes an annular ring section 18 in its outer periphery. Within this ring section 18 there is to be mounted, if desired, devices 20 and 22 which may take the form of radio tuning dials, volume control switches or light switches. The open area within the bracket 16 is closed by a circular and somewhat domed shaped cover assembly 24. The cover assembly 24 is fixed to the bracket 16. It is to be noted that the basic outward surface of the cover assembly 24 as well as the ring section 18 is basically a segment of a sphere to maintain the overall spherical shape.

Also attached to the rod 12 is an upper section 26 which is a thin shell formed basically as a segment of a sphere again maintaining the overall spherical shape.

Attached to the rod 12 within the interior of the member 26 is a motor 28. The motor 28 is electrically driven from a source not shown. The motor 28 is to operate a drive belt 30. The drive belt 30 is connected to a drive wheel 32 which will normally be constructed of rubber or other similar type of resilient material. The drive wheel 32 is in continuous contact with the vertical surface 34 of an annular flange 36.

The drive wheel 32 is rotatably mounted upon shaft 38. The shaft 38 is fixedly secured to a mounting plate 40. The mounting plate 40 is fixedly mounted to the rod 12.

If it is desired, attached to the mounting plate 40 is the electrical equipment, such as a radio 42 and a speaker assembly 44. The speaker 44 is for the purpose of producing an audible signal from the radio 42 and/or from a telephone if the device is connected to a telephone. One or more of the devices 20 or 22 may be directly connected to operate the radio 42 for either tuning and/or volume control.

Rotatably mounted on the periphery of the mounting plate 40 are a plurality of idler wheels 46. There is shown ten in number of wheels 46 but it is to be understood that there may be a greater number or a lesser number of the wheels 46.

Each of the wheels 46 is basically of a resilient material, such as rubber or the like. An annular horizontal section 48 of the flange 36 is in contact with each of the wheels 46 and ride thereupon. Actually, the wheels 46 provide the sole support for the flange 36 and is the only interconnection between the flange 36 and the fixed portion of the lamp.

The flange 36 is secured to shell 50. The shell 50 is basically a large segment of a sphere and the edges of the shell 50 extend from adjacent the upper section 26 to the annular ring 18. The shell 50 revolves during operation of the lamp. The shell 50 may be composed of a translucent material, a transparent material, or combinations thereof, or of any type of material of construction that may be considered to be desirous. The surface area of the shell 50 is maximized to the total area of the lamp so that the maximum amount of area of the sphere revolves. In actual practice, the area of the shell 50 is approximately three to four times as great as the area of the remaining portion of the lamp.

In the operating of the lamp of this invention, the radio may be operated independently of the lamp, as well as the telephone may cause operation of the speaker 44 independently of the lamp. However, it is generally true that when the lamp assembly 14 is lit, the motor assembly 28 causes operation of the drive wheel 32 which, in turn, moves against the flange 36 and in turns causes revolving of the shell 50.

What is claimed is:

1. A spherical shaped rotating hanging lamp to be secured to a horizontal surface such as a ceiling including:

a fixed member, said fixed member including a rod member, an upper section and a lower section, said rod member being adapted to be directly secured to said horizontal surface, said upper section secured to said rod member, said upper section having an exterior section formed in an upper portion of a segment of a sphere, said lower section secured to said rod member and having an exterior surface forming a lower portion of a sphere, said fixed means including a support means;

a drive wheel rotatably mounted upon said fixed member;

motor means coupled to said fixed member for rotating said drive wheel a moveable member rotatably mounted by said support means upon said fixed member, said moveable member including an exterior surface smoothly conforming to the exterior surface of said fixed member, the exterior surface of said moveable member being greater in total area of said fixed member the exterior surfaces of said moveable member and said fixed member cooperating to form an entire sphere; and said support means including an annular inwardly extending flange member secured to said moveable member, said annular inwardly extending flange including a substantially horizontal section and a substantially vertical section; said vertical section being in continuous contact with said drive wheel whereby rotation of said drive wheel by said motor means imparting rotation to said moveable member.

2. The lamp as defined in claim 1 wherein:

said support means includes a supporting wheel assembly, said supporting wheel assembly to be in continuous contact with said horizontal section, said wheel assembly comprising a plurality of spaced apart freely rotating wheels.

3. The lamp as defined in claim 2 wherein:

each of said wheels of said wheel assembly being evenly spaced apart and located in a circular arrangement.

4. The lamp as defined in claim 1 wherein:

said fixed member including electrical apparatus located interiorly thereof with a portion of said electrical apparatus to be positioned directly interiorly of said movable member.

5. The lamp as defined in claim 4 wherein:

said electrical apparatus comprising lighting means.

6. The lamp as defined in claim 5 wherein:

said electrical apparatus also includes an electrical speaker assembly.

7. In combination, a rotating spherical shaped lamp and electronically controlled apparatus adapted to be suspended from a horizontal surface such as a ceiling, said combination comprising:

a fixed member including;

a rod member;

an upper section and a lower section, said upper section being coupled to one end of said rod, said upper and lower sections each being respectively formed as a top segment and bottom segment of a sphere;

a lamp bracket coupled between said lower section and the other end of said sphere;

support means secured to said fixed member;

drive means mounted on said support means;

a rotatable member being rotatably mounted by said support means to said fixed member and being adapted to be rotated by said drive means, said moveable having an exterior section conforming with said top and bottom segments to form said sphere; and a stationary annular ring coupled to said bracket and being spaced between said lower section of said sphere and said rotatable member for holding control devices of said electronically controlled apparatus.

* * * * *